United States Patent [19]

Harada

[11] 4,008,570

[45] Feb. 22, 1977

[54] METHOD AND APPARATUS FOR PURIFYING EXHAUST GASES

[75] Inventor: Masanori Harada, Yokohama, Japan

[73] Assignee: Nissan Motor Co., Ltd., Yokohama, Japan

[22] Filed: Apr. 8, 1975

[21] Appl. No.: 566,131

Related U.S. Application Data

[63] Continuation of Ser. No. 368,487, June 11, 1973, abandoned.

[52] U.S. Cl. ..... 60/299; 23/288 FC; 252/477 R

[51] Int. Cl.² ..... F01N 3/15

[58] Field of Search ..... 60/299, 303, 288, 300; 23/288 FC; 252/477 R

[56] References Cited

UNITED STATES PATENTS

| | | | |
|---|---|---|---|
| 3,770,389 | 10/1973 | Kitzner | 23/288 FC |
| 3,780,772 | 12/1973 | Carnahan | 60/299 |
| 3,793,830 | 2/1974 | August | 60/288 |
| 3,808,806 | 5/1974 | Nakamura | 60/288 |

*Primary Examiner*—Douglas Hart

[57] ABSTRACT

Exhaust gases from an internal combustion are chemically decomposed in a catalytic converter and then oxidized in a thermal reactor.

5 Claims, 4 Drawing Figures

METHOD AND APPARATUS FOR PURIFYING EXHAUST GASES

Figure 1:
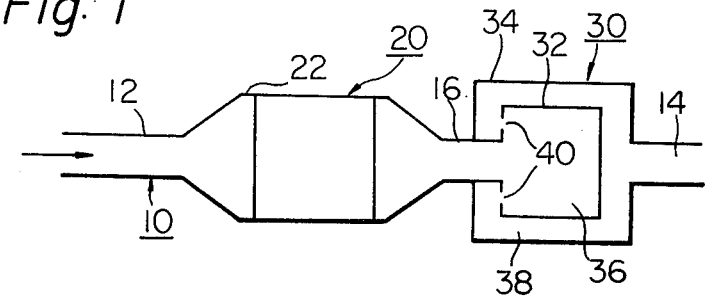

This is a continuation of application Ser. No. 368,487, filed June 11, 1973, and now abandoned.

The present invention generally relates to an internal combustion engine exhaust gas cleaner, and more particularly to method and apparatus for chemically and thermally decomposing harmful compounds contained in exhaust gases.

There are several known ways to convert constituents of incompletely burnt exhaust gases such as hydrocarbons and carbon monoxide into harmless compounds such as carbon dioxide, at a suitable location in an exhaust gas line between an engine exhaust manifold and the outer atmosphere. A typical method uses a catalytic converter in which toxic constituents contained in exhaust gases are, in the presence of supplementary air, decomposed with the aid of a suitable catalyst. Another method uses a thermal reactor in which exhaust gases, which are heated to or maintained at a relatively high temperature, are oxidized to decompose the toxic substances. A number of exhaust gas purifying means thus far proposed are therefore provided with either a catalytic converter or a so-called thermal reactor.

However, it has been realized that both the catalytic converter and the thermal reactor involve some inherent drawbacks. For instance, a catalytic converter must be of considerably large size in order to provide a satisfactory conversion effect. If the size of the converter is limited by design factors, and an undersized unit is therefore provided, the density of the catalyst must extremely high. A catalyst of such a high density will be continuously subjected to an excessive thermal load, resulting in premature fouling and burning thereof and therefore a short life.

In designing a conventional thermal reactor, it has been necessary and usual to locate it very near to the exhaust port of the engine in order to minimize a drop in temperature of gases passing from the manifold into the reactor. A reactor thus located requires not only a large space in an already crowded engine compartment, but sometimes an alteration of the geometry of the existing exhaust manifold. Thus, installation of a thermal reactor within an engine compartment has been a major problem for designers of thermal reactors. Another problem is encountered with this system that the engine compartment will be excessively heated to a high temperature since the temperature of the thermal reactor increase to a higher level during operation thereof. Further, a reactor at this location is continuously exposed to vibrations produced by the engine, which again shorten the life of the reactor.

It is therefore an object of the present invention to provide a method and apparatus which eliminates the aforementioned shortcomings and drawbacks encountered with conventional exhaust cleaners.

Another object of the invention is to provide a highly efficient and operable exhaust cleaner for eliminating harmful substances from exhaust gases by treating the gases in an exhaust system in two separate stages.

Still another object of the invention is to provide an exhaust cleaner having the features described above, which has a prolonged operating life and can be disposed at a convenient location and within a small space in an exhaust system.

According to the present invention, a catalytic converter unit is, as usual, installed in an exhaust system at a certain distance from a vehicle driving engine, and downstream thereof is provided a thermal reactor for further cleaning action. Since residual toxic components contained in exhaust gases after passing through the catalytic converter are thoroughly decomposed by the thermal reactor located downstream thereof, the catalyst may be relatively small in volume and/or low in density. Thus, the drawbacks of a conventional thermal reactor as described above are eliminated in this arrangement. The location of the thermal reactor at a considerable distance from the engine does not adversely affect its performance because the exhaust gases entering the thermal reactor are heated to an effective reaction temperature by the heat of catalytic reaction.

Figure 2:
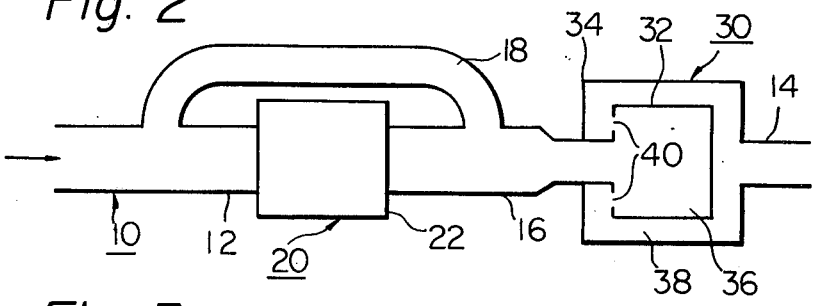
Figure 3:
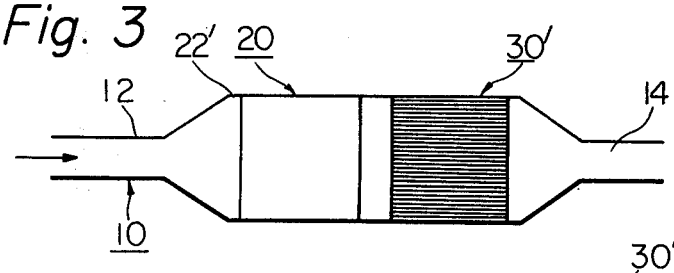
Figure 4:
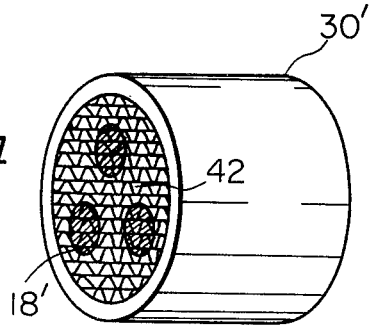

These and other objects and features of the present invention will become more apparent from the following description and the appended claims, with reference to the accompanying drawing, wherein FIG. 1 is a schematic view of a preferred embodiment of the present invention;

FIGS. 2 and 3 are views similar to FIG. 1 but illustrate other preferred embodiments of the present invention; and FIG. 4 is a perspective view on an enlarged scale of a part of the embodiment shown in FIGS. 1, 2 and 3.

In these drawings, similar reference numerals apply to like and corresponding parts.

In FIG. 1, a reference numeral 10 designates a main part of an exhaust system including an exhaust inlet pipe 12 leading from an exhaust manifold (not shown) and an exhaust outlet pipe 14 opening to the ambient atmosphere through a muffler (not shown). A catalytic converter generally indicated as 20 comprises a catalytic mass (no numeral) housed in a casing 22. The catalytic mass 24 may be of any material and type already known, and may comprise a honeycomb shaped catalyst carrier having the catalytic mass carried on the walls at holes. The catalytic converter 20 is preferably equipped with a conventional means for introducing supplementary air, though not illustrated.

Designated by a numeral 30 is a thermal reactor connected in series with and located downstream of the catalytic converter 20, which may be of any conventional configuration. The thermal reactor 30 of the illustrated example consists of two co-axial cylindrical members, of which an inner shell 32 defines a first reaction chamber 36 therewithin and an outer shell 34. The inner shell 32 and outer shell 34 define therebetween a second reaction chamber 38, the two chambers 36 and 38 communicating with each other through a plurality of holes 40 provided in the wall (no numeral) of the inner shell 32. The first reaction chamber 36 communicates with the interior of the casing 22 of the catalytic converter 20 through an intermediate pipe 16, while the second reaction chamber 38 communicates with the atmosphere through the outlet pipe 14. Exhaust gas flow indicated by an arrow passes from the exhaust manifold (not shown) into the catalytic converter 20 and is decomposed therein to a certain extent. The exhaust gases are heated to a relatively high temperature by the heat of reaction and pass into the first reaction chamber 36 of the thermal reactor 30. The exhaust gases then flow through the first reaction chamber 36, the holes 40, the second reaction chamber 38, and any harmful substances which were not decomposed in the catalytic converter 20 are effectively oxidized in the thermal reactor 30. The exhaust gases thus rendered harmless are discharged through the outlet pipe 14 into the open atmosphere.

FIG. 2 illustrates a slightly modified example similarly embodying the present invention. As shown, the inlet pipe 12 branches off upstream of the catalytic converter casing 22 to form a bypass conduit 18. The bypass conduit 18 communicates with the intermediate pipe 16 connecting the catalytic converter 20 with the thermal reactor 30, so that a portion of the exhaust gases is bypassed around the catalytic converter 20 to the thermal reactor 30 without being subjected to catalytic action. This embodiment is particularly advantageous if highly efficient catalyzing action can be expected from the catalytic mass. If all exhaust gas is passed through such an efficient catalytic mass, the catalyst will be thermally loaded to an extreme extent with the result of a short operating life as already discussed. The untreated portion of the exhaust gas conducted through the bypass conduit 18 is admixed with the remaining portion of the exhaust gas leaving the catalytic converter 20 downstream thereof, the mixture then being passed into and oxidized in the thermal reactor 30.

According to another example shown in FIG. 3, the catalytic converter 20 and a thermal reactor 30' are accommodated in a unitary housing 22'. In this example, a thermal reactor 30' comprises a ceramic cylinder 42 as shown in FIG. 4, which is composed of a catalytic material similar to that of the catalytic converter 20. Passageways 18' formed within the thermal reactor 30', which carry no catalytic agent, serve as reaction chambers in this embodiment. Exhaust gases from the catalytic converter 20 are directly passed into the thermal reactor 30' to be re-combusted and decomposed therein.

If desired, the catalytic converter 20 in the embodiment of FIG. 3 may have an identical configuration with the thermal reactor 30'. In this case, the passageways 18' substantially correspond in function with the bypass conduit 18 of FIG. 2. A portion of the exhaust gases is therefore capable of freely passing through the passageways 18'. In addition to the function similar to the bypass conduit 18, these passageways 18' are advantageous in another respect in that the exhaust gases passing therethrough are more reliably heated to a suitable temperature for thermal reaction by the reaction heat of the catalyst **24*c* surrounding the passageways 18'**.

What is claimed is:

1. An apparatus for purifying exhaust gases discharged from an internal combustion engine having an exhaust manifold, comprising:

an exhaust gas pipe leading from said exhaust manifold to the atmosphere;

a catalytic converter disposed in said exhaust gas pipe at a certain distance from the engine, said catalytic converter including a monolithic ceramic honeycomb cylinder which is formed with a thin wall structure and has a upstream end and a downstream end, said honeycomb cylinder being separated into a catalytic portion which is formed with a plurality of thin walls carrying a catalytic material and a passage portion other than said catalytic portion which is formed with a plurality of thin walls carrying no catalytic material and integral with the thin walls of said catalytic portion, said catalytic portion extending through said honeycomb cylinder from the upstream to downstream ends thereof and serves as a catalytic reactor, said passage portion extending through said honeycomb cylinder from the upstream to downstream ends thereof and serving as a mere passage for allowing the exhaust gases to pass through said honeycomb cylinder; and a thermal reactor disposed in said exhaust pipe downstream of said catalytic converter.

2. An apparatus as claimed in claim 1, in which said passage portion is in cylindrical form.

3. An apparatus as claimed in claim 1, in which said passage portion includes a plurality of portions in cylindrical form.

4. An apparatus as claimed in claim 3, in which said plurality of portions includes three cylindrical portions.

5. An apparatus as claimed in claim 1, in which said monolithic honeycomb cylinder is formed with a plurality of flat thin walls and a plurality of corrugated thin walls which are disposed between the flat thin walls.

* * * * *